US007183913B2

(12) United States Patent
Hughes et al.

(10) Patent No.: US 7,183,913 B2
(45) Date of Patent: Feb. 27, 2007

(54) LIFE RAFT CONTAINER SECURITY SYSTEM AND METHOD

(75) Inventors: C. Duff Hughes, Baltimore, MD (US); Frank Hornig, Annapolis, MD (US); Kevin Brophy, Baltimore, MD (US)

(73) Assignee: Vane Line Bunkering, Inc., Baltimore, MD (US)

( * ) Notice: Subject to any disclaimer, the term of this patent is extended or adjusted under 35 U.S.C. 154(b) by 114 days.

(21) Appl. No.: 10/449,325

(22) Filed: May 30, 2003

(65) Prior Publication Data

US 2004/0239435 A1 Dec. 2, 2004

(51) Int. Cl.
*G08B 13/14* (2006.01)

(52) U.S. Cl. ..... 340/568.1; 340/539.15; 340/539.23; 340/571; 340/686.4; 340/686.6

(58) Field of Classification Search ..... 340/568.1, 340/568.5, 572.9, 571, 572.2, 572.1
See application file for complete search history.

(56) References Cited

U.S. PATENT DOCUMENTS 4,267,553 A * 5/1981 Vogelsanger et al. ..... 340/571
4,845,470 A * 7/1989 Boldt, Jr. ..... 340/540
5,406,263 A * 4/1995 Tuttle ..... 340/572.1
5,646,592 A 7/1997 Tuttle
5,805,066 A * 9/1998 Murdy ..... 340/568.1
5,831,531 A 11/1998 Tuttle
5,974,078 A * 10/1999 Tuttle et al. ..... 375/130
6,078,251 A 6/2000 Landt et al.
6,148,291 A 11/2000 Radican
6,170,742 B1 1/2001 Yacoob
6,232,877 B1 * 5/2001 Ashwin ..... 340/572.1
6,323,782 B1 * 11/2001 Stephens et al. ..... 340/10.31
6,407,665 B2 * 6/2002 Maloney ..... 340/568.1
6,557,752 B1 5/2003 Yacoob
6,563,425 B2 5/2003 Nicholson et al.
6,784,796 B2 * 8/2004 Johnston et al. ..... 340/568.1
6,879,257 B2 * 4/2005 Hisano et al. ..... 340/568.2
6,954,145 B2 * 10/2005 Nakamura et al. ..... 340/553
7,019,640 B2 * 3/2006 Canich et al. ..... 340/531
2002/0067264 A1 6/2002 Soehnlen
2002/0130778 A1 9/2002 Nicholson
2003/0195644 A1 * 10/2003 Borders et al. ..... 700/90

* cited by examiner

*Primary Examiner*—Benjamin C. Lee
*Assistant Examiner*—Son Tang
(74) *Attorney, Agent, or Firm*—Thompson Coburn LLP

(57) ABSTRACT

A method comprises providing a container having a first container portion and a second container portion, placing an inflatable life raft within the container, placing a transmitter mechanism adjacent the container, and automatically detecting whether a tamper condition has occurred. The tamper condition comprises at least one of the following: removal of the life raft from the container; an increase in distance between the first and second container portions; and a change in position of at least a portion of the life raft relative to one of the portions of the container. The transmitter mechanism is adapted and configured to transmit a signal upon the detection of the tamper condition.

48 Claims, 2 Drawing Sheets

LIFE RAFT CONTAINER SECURITY SYSTEM AND METHOD

BACKGROUND OF THE INVENTION

The conventional practice of inspecting, packing and delivering maritime life rafts presents a potential security risk to the ultimate consumer in that raft containers can be easily tampered with in a manner to conceal potentially dangerous materials while the containers are en route to the consumer. Existing life raft containers are packaged at the manufacturer, opened and inspected annually by maintenance facilities and are secured only by external plastic or metal banding straps. It is possible for a terrorist to intercept a container in transit, remove the external banding straps, insert a weapon of mass destruction or high explosives, re-band the unit and return it to its transit point without anyone else ever noticing that the unit has been compromised.

SUMMARY OF THE INVENTION

A method of the present invention comprises providing a container having a first container portion and a second container portion, placing an inflatable life raft within the container, placing a transmitter mechanism adjacent the container, and automatically detecting whether a tamper condition has occurred. The tamper condition comprises at least one of the following: removal of the life raft from the container; an increase in distance between the first and second container portions; and a change in position of at least a portion of the life raft relative to one of the portions of the container. The transmitter mechanism is adapted and configured to transmit a signal upon the detection of the tamper condition.

Another aspect of the present invention is a method comprising providing a container having a first container portion and a second container portion, placing an article within the container, placing a transmitter mechanism adjacent the container, automatically detecting whether a removed tamper condition has occurred, automatically detecting whether a distance increase tamper condition has occurred, and automatically detecting whether a position change tamper condition has occurred. The removed tamper condition comprises a condition in which the article is removed from the container. The distance increase tamper condition comprises an increase in distance between the first and second container portions. The position change tamper condition comprises a change in position of at least a portion of the article relative to one of the portions of the container.

Another aspect of the present invention is a method comprising providing a container having a first container portion and a second container portion, placing an inflatable life raft within the container, and automatically detecting whether a tamper condition has occurred. The tamper condition comprises at least one of the following: removal of the life raft from the container, an increase in distance between the first and second container portions, and a change in position of at least a portion of the life raft relative to one of the portions of the container. The method further comprises intermittently transmitting a status signal. The status signal is a tamper signal if after a point in time the tamper condition is detected via the detecting step. The status signal is a non-tamper signal if after the point in time the tamper condition is not detected via the detecting step. The tamper signal is different than the non-tamper signal.

Another aspect of the present invention is a method comprising providing a container having a first container portion and a second container portion, placing an article within the container, placing a transmitter mechanism within the container, and automatically detecting whether a distance increase tamper condition has occurred. The distance increase tamper condition comprises an increase in distance between the first and second container portions. The method further comprises automatically detecting whether a position change tamper condition has occurred. The position change tamper condition comprises a change in position of at least a portion of the article relative to one of the portions of the container.

Another aspect of the present invention is a method comprising providing a container, placing an article within the container, and providing an RFID system comprising a mother RFID tag and a daughter RFID tag. The RFID system is adapted and configured to detect a change in position of the daughter tag relative to the mother tag. The method further comprises placing one of the mother and daughter RFID tags adjacent the container, placing the other of the mother and daughter RFID tags adjacent the article, and detecting with the RFID system whether a tamper condition has occurred. The tamper condition comprises a change in position of the daughter tag relative to the mother tag. The RFID system is adapted and configured to transmit a tamper signal upon detection of the tamper condition.

Another aspect of the present invention is a method comprising providing a plurality of assemblies. Each assembly comprises a container having first and second container portions, an article within the container, and a detector mechanism adapted and configured to detect the occurrence of a tamper condition. The tamper condition comprises at least one of the following: removal of the article from the container, increasing distance between the first and second container portions, and a change in position of at least a portion of the article relative to one of the portions of the container. The method further comprises transporting the plurality of assemblies in one shipment from an initial location to a quarantine location, determining for each of the plurality of assemblies whether the detector mechanism corresponding to said each of the plurality of assemblies has detected the occurrence of the tamper condition, and transporting the plurality of assemblies from the quarantine location to a destination location. The determining step occurs with the plurality of assemblies at the quarantine location. The step of transporting the plurality of assemblies from the quarantine location to the destination location occurs after the determining step.

Another aspect of the present invention is an anti-tamper life raft assembly comprising a container, an inflatable life raft, and a transmitter mechanism. The container has a first container portion and a second container portion. The inflatable life raft is within the container. The transmitter mechanism is adapted and configured to transmit a signal upon the occurrence of a tamper condition and indicative of the tamper condition. The tamper condition comprises at least one of the following: removal of the life raft from the container, increasing distance between the first and second container portions, and a change in position of at least a portion of the life raft relative to one of the portions of the container.

Another aspect of the present invention is an anti-tamper assembly comprising a container, an article, and a detector mechanism. The container has a first container portion and a second container portion. The article is within the container. The detector mechanism is adapted and configured to detect whether a removed tamper condition has occurred. The removed tamper condition comprises a condition in which the article is removed from the container. The detector mechanism is further adapted and configured to detect whether a distance increase tamper condition has occurred. The distance increase tamper condition comprises an increase in distance between the first and second container portions.

Another aspect of the present invention is an anti-tamper life raft assembly comprising a container, an inflatable life raft and a detector mechanism. The container has a first container portion and a second container portion. The life raft is within the container. The detector mechanism is adapted and configured to detect the occurrence of a tamper condition. The tamper condition comprises at least one of the following: removal of the life raft from the container, increasing distance between the first and second container portions, and a change in position of at least a portion of the life raft relative to one of the portions of the container.

Other features and advantages will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
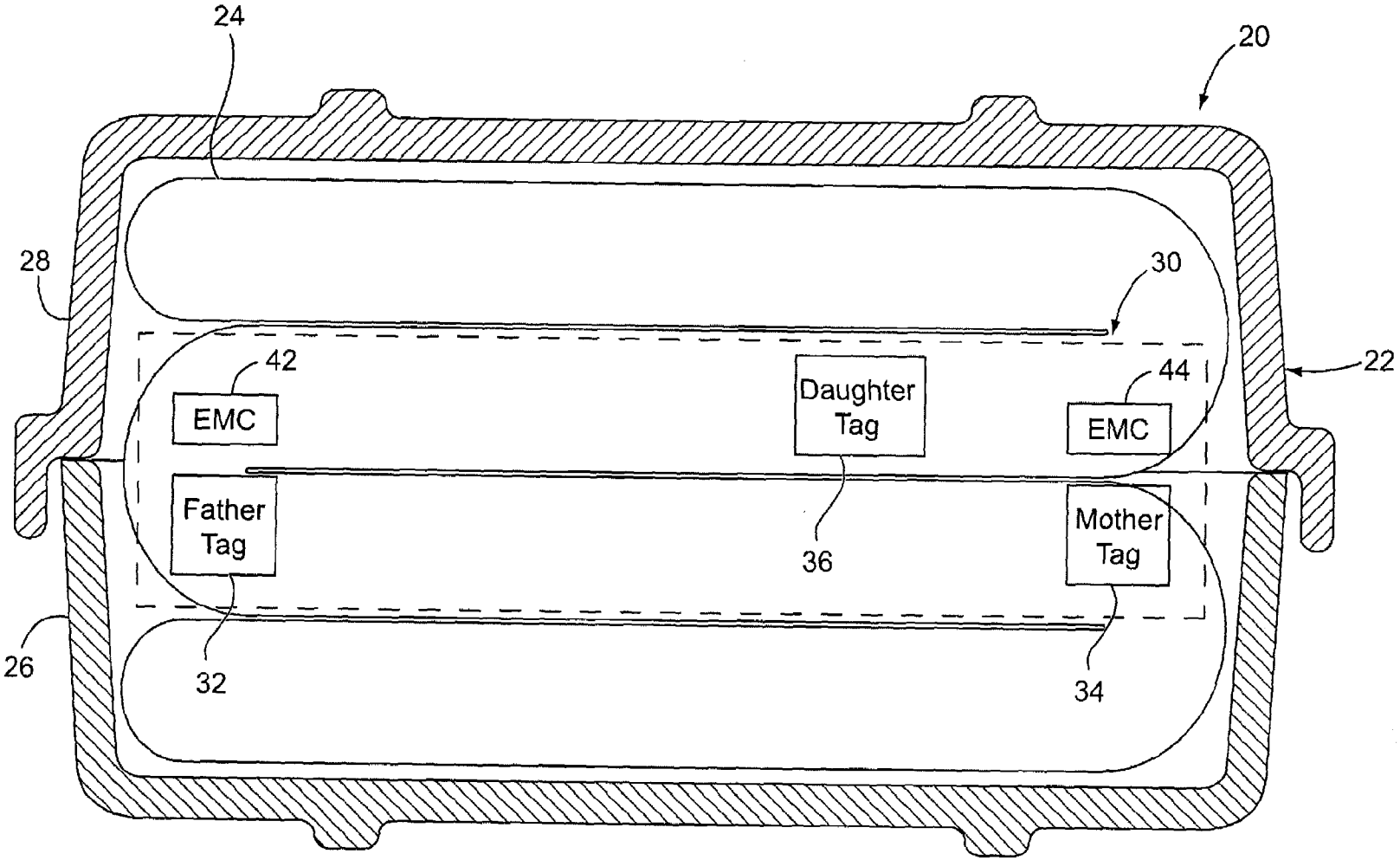
FIG. 1 is a schematic drawing of an anti-tamper life raft assembly of the present invention.

Referring now to the drawings, and more particularly to FIG. 1, an anti-tamper life raft assembly of the present invention is indicated in its entirety by the reference numeral 20. The anti-tamper life raft assembly 20 comprises a container, generally indicated at 22, an inflatable life raft 24, and a detector mechanism. The container 22 comprises first and second container portions 26, 28. The detector mechanism preferably constitutes an aspect of a dedicated short range communication system such as a radio frequency identification ("RFID") system, generally indicated at 30. Although the embodiment described herein preferably employs an RFID system, it is to be understood that other dedicated short range communication systems or even other types of detector mechanisms may be employed without departing from the scope of the present invention.

In the present embodiment, the first container portion 26 comprises a container bottom piece and the second container portion 28 comprises a container top piece. In other words, the container 22 of the present invention comprises a two-piece container. However, it is to be understood that the first and second container portions may be integral portions of a single piece without departing from the scope of the present invention. The life raft 24 is within the container 22.

Preferably, the RFID system 30 is adapted and configured to detect whether any one of several tamper conditions have occurred. The tamper conditions correspond to various possible tamper events. Possible tamper events include: temporarily opening the container 22 to insert an unauthorized object (e.g., a hazardous material) in the container; cutting a hole in the container 22 and inserting an unauthorized object without opening the container (this event may cause the life raft 24 to shift or move relative to the container); replacement of the life raft with an unauthorized object; etc. The tamper conditions include a distance increase tamper condition, a position change tamper condition, and a removed life raft tamper condition. The distance increase tamper condition comprises an increase in distance between the first and second container portions 26, 28 (e.g., separation of the container top piece from the container bottom piece). The position change tamper condition comprises a change in position of at least a portion of the life raft 24 relative to one of the first and second container portions 26, 28. The removed life raft tamper condition comprises removal of the life raft 24 from the container 22. The RFID system 30 preferably comprises a father RFID tag 32, a mother RFID tag 34, and a daughter RFID tag 36. Preferably, all three tags are within the container 22. As used herein, a tag within the container means the tag is inside the container or is otherwise associated with the container (e.g., secured to an interior or exterior surface of the container). Preferably, each tag is adapted and configured to transmit a signal indicative of at least one of the tamper conditions upon the occurrence of such tamper condition. Alternatively or additionally, the tags communicate with each other in a manner such that at least one of the tags is adapted and configured to transmit different signals indicative of two or more of the tamper conditions upon the occurrence of the tamper conditions. Thus, the RFID system 30 comprises a transmitter mechanism adapted and configured to transmit a signal upon the detection of a tamper condition.

Preferably, the father RFID tag 32 is affixed to an inside panel of the container bottom piece 26 and is associated with an electronic magnetic contact 42 affixed to an inside panel of the container top piece 28. The father RFID tag 32 is preferably adapted and configured to detect whether the distance increase tamper condition has occurred. In particular, the father RFID tag 32 is preferably adapted and configured to detect whether the container top and bottom pieces 26, 28 are separated by more than ½ centimeter. The father RFID tag 32 is also preferably adapted and configured to transmit a distance increase RF signal upon detection of the distance increase tamper condition.

The mother RFID tag 34 is preferably affixed to an inside panel of the container bottom piece and is associated with an electronic magnetic contact 44 affixed to an inside panel of the container top piece 28. Preferably, the daughter tag 36 is affixed to the life raft 24. Preferably, the mother RFID tag 34 also is adapted and configured to detect whether the distance increase tamper condition has occurred. In particular, the mother RFID tag 34 is preferably adapted and configured to detect whether the container top and bottom pieces 26, 28 are separated by more than ½ centimeter. It is to be understood that although the life raft 24 is schematically shown in FIG. 1, the life raft is rolled up and or folded in a manner that it fits snugly in the container 22. As such, with the container top piece 28 properly positioned on and secured to the container bottom piece 26 and the life raft 24 inside the container 22, the life raft shifts only minimally (if at all) relative to the container. Because the life raft 24 at most shifts only minimally relative to the container 22 during non-tamper conditions, the daughter tag 36 moves only minimally (if at all) relative to the mother tag 34 during non-tamper conditions. The mother and daughter RFID tags 34, 36 are adapted and configured to detect the position change tamper condition and the removed life raft tamper condition. The mother and daughter RFID tags 34, 36 are symbiotically linked to one another to detect whether the spacing between the mother and daughter RFID tags is changed from a distance D. During non-tamper conditions, the mother and daughter RFID tags 34, 36 are spaced from each other by the distance D (e.g., twelve inches). The mother and daughter RFID tags 34, 36 are adapted and configured to detect whether the spacing between each other is increased or decreased beyond a predetermined amount. The daughter and mother RFID tag relationship is an active, constantly communicating relationship. The daughter tag preferably communicates on a predetermined schedule ensuring that the mother RFID tag is within proximity. Failure to contact the mother RFID tag during a polling cycle is indicative of the tamper condition. Additionally, the mother RFID tag preferably actively communicates with the daughter tag on a unique polling sequence and also detects whether the proximity has been compromised. The mother RFID tag 34 is preferably adapted and configured to transmit a distance increase RF signal upon detection of the distance increase tamper condition, to transmit a position change RF signal upon detection of the position change tamper condition, and a removed life raft RF signal upon detection of the removed life raft tamper condition. It is to be understood that depending upon how the mother and daughter tags are configured, the position change RF signal may be the same as or different than the removed life raft tamper condition. The daughter RFID tag 36 is preferably adapted and configured to transmit a position change RF signal upon detection of the position change tamper condition, and a removed life raft RF signal upon detection of the removed life raft tamper condition.

Figure 2:
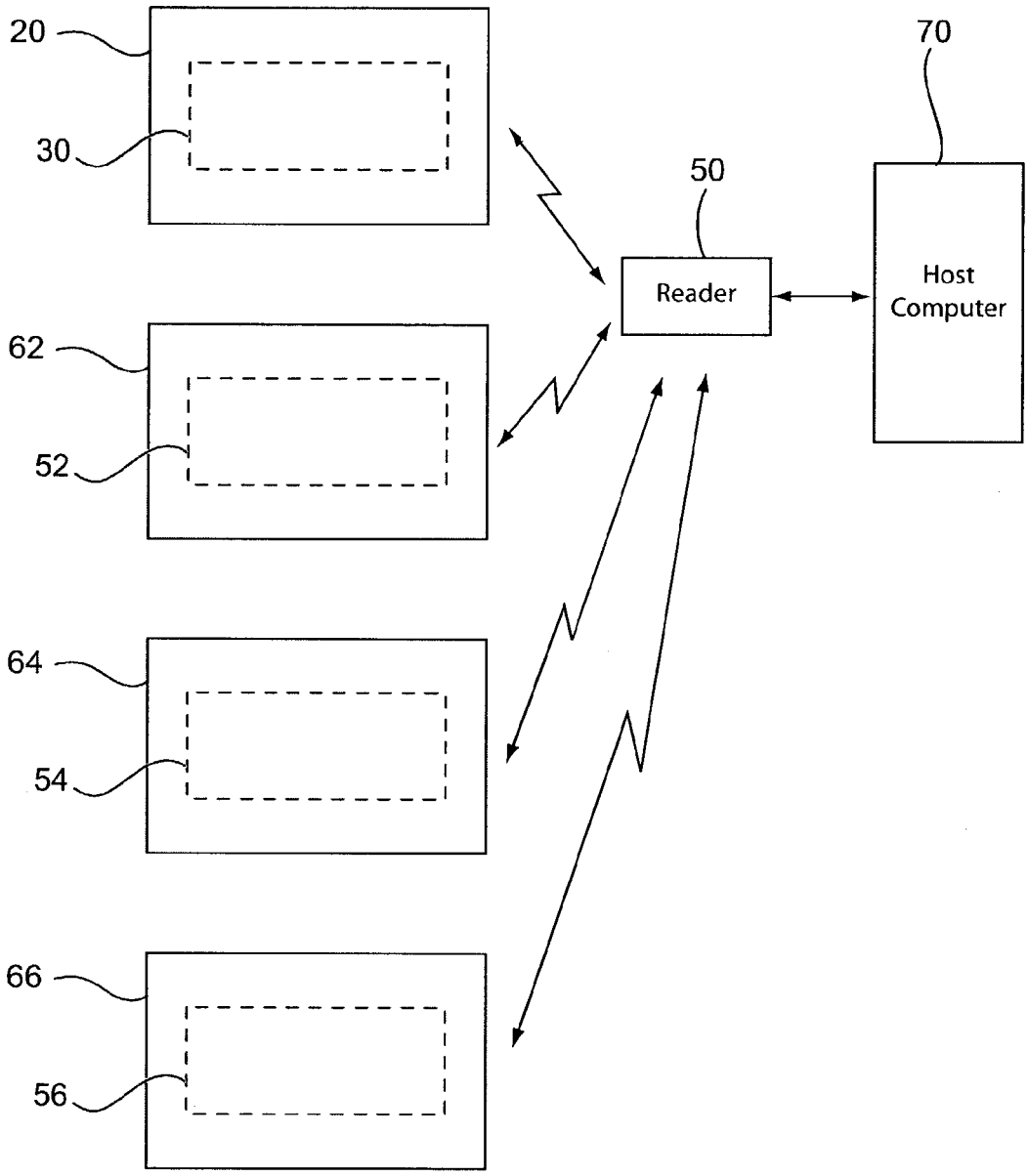
FIG. 2 is a schematic drawing of a plurality of life raft assemblies adapted and configured to communicate with a field generation apparatus.

Referring to FIG. 2, the RFID system 30 and a remote field generation apparatus 50 are adapted and configured to communicate with one another. The field generation apparatus 50 is adapted and configured to receive the various RF signals from the RFID tags 32, 34, 36 of the RFID system 30. Preferably, the field generation apparatus 50 and the RFID system 30 are adapted and configured to communicate with each other using spread spectrum communication. The field generation apparatus 50 is also adapted and configured to simultaneously communicate with a plurality of RFID systems (e.g., RFID systems 52, 54, 56 shown in FIG. 2). As discussed below, a plurality of anti-tamper life raft assemblies (e.g., systems 20, 62, 64, 66 shown in FIG. 2) may be transported in a single shipment and interrogated by the field generation apparatus 50. Preferably, the field generation apparatus 50 is a portable hand-held apparatus. Although only the anti-tamper life raft assembly 20 is described in detail herein, it is to be understood that the description thereof is equally applicable to the other anti-tamper life raft assemblies 62, 64, 66. However, each RFID tag of each anti-tamper life raft assembly preferably transmits a unique identification signal readable by the field generation apparatus 50 so that an operator operating the field generation apparatus can determine which tag of which life raft assembly is communicating with it. Preferably, the field generation apparatus 50 includes VLSI integrated circuit and computer technology. This enables the field generation apparatus to be compact. Preferably, each tag sends its data intermittently, and more preferably periodically. The field generation apparatus 50 is adapted and configured to cross-reference the data received from each RFID tag with data stored within the apparatus' self-contained database. After the field generation apparatus 50 receives new data, it preferably sends the data to a host computer 70. The field generation apparatus 50 and the host computer 70 preferably communicate through a secure wireless link.

Referring again to FIG. 1, the RFID tags 32, 34, 36 are preferably active RFID tags powered by long life lithium ion batteries capable of two year sustained transmit duty cycle. Also preferably, each tag has an embedded anti-tamper mechanism which is of an electro-magnetic design. The tags are fully configurable via software by a base station. Configuration commands are sent to the tags via RFID secure transmission and are accepted only from the originating configuration station. Preferably, all other commands are rejected by the tags and cause a tamper event to be raised. Also, erasure of the command control set on any tag is treated as a tamper event.

Preferably, the tags have four modes of operation. The first mode is a no report (disabled) mode. The no report mode is a maintenance mode in which the cards are delivered to the originating configuration station. In the no report mode, the tamper controls, batteries and RFID signaling process are disabled. The second mode is a real-time mode. The real-time mode is the most active reporting state of the tangs. In the real-time mode, the tags are constantly reporting when in proximity of an authorized base station. As the tags approach an antenna field (e.g., within 100 meters) the tags begin actively responding to interrogations and report their status (i.e., begin transmitting appropriate RF signals). Two real-time sub modes exist: RT tamper enabled, and RT tamper disabled. In the real-time mode with tamper enabled, the RFID tags report tamper conditions and then reset if the condition that caused the tamper to activate terminates. In the real-time mode with tamper disabled, the RFID tags report status, programmed data and battery status only. The third mode is a history mode. The history mode is the most secure mode of operation. Once placed in the history mode all symbiotic relationships and perimeter defense functions are activated. If any perimeter or relationship is compromised, the tags immediately report the compromise, wait a predetermined period of time for a base station to respond and if no response is received enter into a sleep-transmit-sleep state until being within range of an authorized base station. Internal anti-tamper circuitry is locked in the alarm state and cannot be reset. The fourth mode is an inventory mode. The inventory mode is an active mode that reports only a unique identification of the tag to an authorized base station. This mode is used for inventory control where anti-tamper requirements do not exist.

Preferably, each of the RFID tags 32, 34, 36 is adapted and configured to intermittently transmit a status signal. The status signal is one of the tamper signals if a corresponding one of the tamper conditions is detected. The status signal is a non-tamper signal if after the point in time the tamper condition is not detected. Preferably, the tamper signal is different than the non-tamper signal.

Referring again to FIG. 2, in operation the plurality of anti-tamper life raft assemblies 20, 62, 64, 66 shown in FIG. 2) are assembled and configured, preferably at the originating configuration station. Although only four life raft assemblies are shown herein, it is to be understood that four are shown for convenience. It is to be understood that many more may be employed without departing from the scope of the present invention. The configured life raft assemblies 20, 62, 64, 66 are then transported from an initial location (e.g., the configuration station) to a quarantine location. Preferably, the initial location is the supplier of the life raft assemblies and the quarantine location is in the control of a customer (e.g., an owner of one or more ships). The quarantine location may be hundreds or thousands of miles from the initial location. The transportation may be conducted by a third party carrier. In other words, the transportation of the life raft assemblies from the initial location to the quarantine location may be conducted by a party other than the supplier or customer and outside the control of the supplier or customer. With the assemblies at the quarantine location, the customer or an authorized representative of the supplier operates the field generation apparatus 50 to interrogate the RFID tags of each of the life raft assemblies. The RFID tags then transmit their RF status signals. If any of the RFID tags detect the occurrence of a tamper condition, the RFID system associated with the RFID tag will transmit an appropriate tamper indicating signal. Preferably, the tamper signal indicates the specific tag that detected the tamper condition and indicates the type of tamper condition, the operator can take appropriate action (e.g., removing the offending life raft assembly from the other assemblies). After interrogation, the life raft assemblies may be transported from the quarantine location to a destination location (e.g., a ship). Preferably, transporting the life raft assemblies from the quarantine location to the destination location is performed under the control of the customer. Preferably, only the life raft assemblies of which it has been determined that no tamper condition has occurred are transported from the quaratine location to the destination location. The ability to detect whether a tamper condition has occurred enables the supplier and customer to employ a third party to transport the life raft assemblies from the supplier to the customer.

Although the preferred embodiment has been described in relation to life raft assemblies, it is to be understood that other types of assemblies may be employed without departing from the scope of this invention. In other words, some article other than a life raft may be employed. For brevity, an embodiment employing an article other than a life raft is not described in detail. However, it is to be understood that the above description is equally applicable to other articles.

In view of the above, it will be seen that several advantageous results are attained by the present invention.

As various changes could be made in the above constructions and methods without departing from the scope of the invention, it is intended that all matter contained in the above description or shown in the accompanying drawings shall be interpreted as illustrative and not in a limiting sense. The invention therefore shall be limited solely by the scope of the claims set forth below.

What is claimed is:

1. A method comprising:

providing a container having a first container portion and a second container portion;

placing an inflatable life raft within the container;

placing a transmitter mechanism adjacent the container;

automatically detecting whether a position change tamper condition has occurred, the position change tamper condition comprising a change in position of at least a portion of the life raft within the container relative to one of the portions of the container;

placing an RFID system within the container, the RFID system comprising a plurality of RFID tags, the RFID system being adapted and configured to perform said automatically detecting whether the position change tamper condition has occurred;

the transmitter mechanism being adapted and configured to transmit a signal upon the detection of the position change tamper condition.

2. A method as set forth in claim 1 further comprising:

automatically detecting whether a distance increase tamper condition has occurred, the distance increase tamper condition comprising an increase in distance between the first and second container portions; and automatically detecting whether a removed life raft tamper condition has occurred, the removed life raft tamper condition comprising removal of the life raft from the container.

3. A method as set forth in claim 2 wherein the transmitter mechanism is adapted and configured to transmit a signal upon the detection of any of the tamper conditions.

4. A method as set forth in claim 3 further comprising:

placing a dedicated short range communication system within the container, the transmitter mechanism being a portion of the dedicated short range communication system.

5. A method as set forth in claim 4 wherein the dedicated short range communication system comprises the RFID system.

6. A method as set forth in claim 3 wherein the RFID system is adapted and configured to detect whether any of the tamper conditions have occurred, the transmitter mechanism being a portion of the RFID system.

7. A method as set forth in claim 6 wherein the transmitter mechanism comprises portions of at least two of the RFID tags.

8. A method as set forth in claim 6 wherein the RFID system comprises a father RFID tag, a mother RFID tag and a daughter RFID tag, and wherein the step of placing an RFID system within the container comprises:

placing the father and mother RFID tags within the container;

attaching the daughter RFID tag to the life raft.

9. A method as set forth in claim 8 wherein:

the father RFID tag is adapted and configured to detect whether the distance increase tamper condition has occurred; and the mother and daughter RFID tags are adapted and configured to detect whether the removed life raft tamper condition has occurred.

10. A method as set forth in claim 8 wherein:

the RFID system is adapted and configured to detect whether the mother and daughter RFID tags are spaced from each other by a distance greater than a distance D;

the RFID system is adapted and configured to transmit a signal upon detection of the mother and daughter tags being spaced from each other by a distance greater than the distance D.

11. A method as set forth in claim 6 wherein the RFID tags are active RFID tags.

12. A method as set forth in claim 11 wherein:

the RFID system is adapted and configured to transmit a removed life raft signal upon detection of the removed life raft tamper condition; and the RFID system is adapted and configured to transmit a distance increase signal upon detection of the distance increase tamper condition.

13. A method as set forth in claim 12 wherein the distance increase signal is different than the removed life raft signal.

14. A method as set forth in claim 13 further comprising:

providing a remote field generation apparatus, the field generation apparatus being adapted and configured to receive the distance increase signal and the removed life raft signal.

15. A method as set forth in claim 14 wherein the RFID system and the field generation apparatus are adapted and configured to communicate with each other using spread spectrum communication.

16. A method as set forth in claim 6 further comprising:

providing a remote field generation apparatus, the field generation apparatus and the RFID system being adapted and configured to communicate with each other using spread spectrum communication.

17. A method as set forth in claim 1 further comprising:

automatically detecting whether a distance increase tamper condition has occurred, the distance increase tamper condition comprising an increase in distance between the first and second container portions; and wherein the transmitter mechanism is adapted and configured to transmit a signal upon the detection of either of the tamper conditions.

18. A method as set forth in claim 1 further comprising:

automatically detecting whether a removed life raft tamper condition has occurred, the removed life raft tamper condition comprising removal of the life raft from the container; and wherein the transmitter mechanism is adapted and configured to transmit a signal upon the detection of either of the tamper conditions.

19. A method as set forth in claim 1 further comprising:

intermittently transmitting a status signal, the status signal being transmitted by the transmitter mechanism, the status signal being a tamper signal if after a point in time the tamper condition is detected via the detecting step, the status signal being a non-tamper signal if after the point in time the tamper condition is not detected via the detecting step, the tamper signal being different than the non-tamper signal.

20. A method comprising:

providing a container having a first container portion and a second container portion;

placing an article within the container;

placing a transmitter mechanism adjacent the container;

automatically detecting whether a removed tamper condition has occurred, the removed tamper condition comprising a condition in which the article is removed from the container;

automatically detecting whether a distance increase tamper condition has occurred, the distance increase tamper condition comprising an increase in distance between the first and second container portions; and automatically detecting whether a position change tamper condition has occurred, the position change tamper condition comprising a change in position of at least a portion of the article within the container relative to one of the portions of the container placing an RFID system within the container, the RFID system comprising a plurality of RFID tags, the RFID sytem being adapted and configured to detect whether any of the tamper conditions have occured, the transmitter mechanism being a portion of the RFID system.

21. A method as set forth in claim 19 wherein the transmitter mechanism is adapted and configured to transmit a signal upon the detection of any of the tamper conditions.

22. A method as set forth in claim 19 wherein the RFID system comprises a father RFID tag, a mother RFID tag and a daughter RFID tag, and wherein the step of placing an RFID system within the container comprises:

placing the father and mother RFID tags within the container;

attaching the daughter RFID tag to the article.

23. A method as set forth in claim 21 wherein:

the RFID system is adapted and configured to detect whether the mother and daughter RFID tags are spaced from each other by a distance greater than a distance D;

the RFID system is adapted and configured to transmit a signal upon detection of the mother and daughter tags being spaced from each other by a distance greater than the distance D.

24. A method as set forth in claim 23 wherein:

the father RFID tag is adapted and configured to detect whether the distance increase tamper condition has occurred.

25. A method as set forth in claim 19 wherein:

the RFID system is adapted and configured to transmit a removed signal upon detection of the removed tamper condition; and the RFID system is adapted and configured to transmit a distance increase signal upon detection of the distance increase tamper condition, the distance increase signal being different than the removed signal.

26. A method as set forth in claim 23 further comprising:

providing a remote field generation apparatus, the field generation apparatus being adapted and configured to receive the distance increase signal and the removed signal.

27. A method as set forth in claim 19 further comprising:

providing a remote field generation apparatus, the field generation apparatus and the RFID system being adapted and configured to communicate with each other using spread spectrum communication.

28. A method as set forth in claim 19 further comprising:

intermittently transmitting a status signal, the status signal being transmitted by the transmitter mechanism, the status signal being a tamper signal if after a point in time any of the tamper conditions are detected via the detecting step, the status signal being a non-tamper signal if after the point in time any of the tamper conditions are not detected via the detecting step, the tamper signal being different than the non-tamper signal.

29. A method comprising:

providing a container having a first container portion and a second container portion;

placing an inflatable life raft within the container;

automatically detecting whether a position change tamper condition has occurred, the position change tamper condition comprising a change in position of at least a portion of the life raft within the container relative to one of the portions of the container;

placing an RFID system within the container, the RFID system comprising a plurality of RFID tags, the RFID system being adapted and configured to perform said automatically detecting whether a position change tamper condition has occurred;

intermittently transmitting a status signal, the status signal being a tamper signal if after a point in time the position change tamper condition is detected via the detecting step, the status signal being a non-tamper signal if after the point in time the position change tamper condition is not detected via the detecting step, the tamper signal being different than the non-tamper signal.

30. A method as set forth in claim 27 further comprising:

automatically detecting whether a distance increase tamper condition has occurred, the distance increase tamper condition comprising an increase in distance between the first and second container portions.

31. A method as set forth in claim 28 wherein the tamper signal is a distance increase signal if after the point in time the distance increase tamper condition is detected via the detecting step, the tamper signal being a position change signal if after the point in time the position change tamper condition is detected via the detecting step, the distance increase signal being different than the position change signal.

32. A method comprising:

providing a container having a first container portion and a second container portion;

placing an article within the container;

placing a transmitter mechanism within the container;

automatically detecting whether a distance increase tamper condition has occurred, the distance increase tamper condition comprising an increase in distance between the first and second container portions;

automatically detecting whether a position change tamper condition has occurred, the position change tamper condition comprising a change in position of at least a portion of the article within the container relative to one of the portions of the container; and placing an RFID system within the container, the RFID system comprising a plurality of RFID tags, the RFID system being adapted and configured to perform said automatically detecting whether a position change tamper condition has occurred.

33. A method as set forth in claim 30 further comprising:

placing a dedicated short range communication system within the container, the transmitter mechanism being a portion of the dedicated short range communication system, the dedicated short range communication system being adapted to detect whether either of the tamper conditions have occurred.

34. A method as set forth in claim 30 further comprising:

intermittently transmitting a status signal, the status signal being transmitted by the transmitter mechanism, the status signal being a tamper signal if after a point in time at least one of the tamper conditions is detected via at least one of the detecting steps, the status signal being a non-tamper signal if after the point in time neither of the tamper conditions are detected via the detecting steps, the tamper signal being different than the non-tamper signal.

35. A method as set forth in claim 30 further comprising:

intermittently transmitting a status signal, the status signal being transmitted by the transmitter mechanism, the status signal being a distance increase signal if after a point in time the distance increase tamper condition is detected via the step of detecting whether the distance increase tamper condition has occurred, the status signal being a position change signal if after the point in time the position change tamper condition is detected via the step of detecting whether the position change tamper condition has occurred, the status signal being a non-tamper signal if after the point in time neither of the tamper conditions are detected via the detecting steps, the non-tamper signal being different than the distance increase signal, the non-tamper signal being different than the position change signal.

36. A method as set forth in claim 35 wherein the distance increase signal is different than the position change signal.

37. A method comprising:

providing a container;

placing an article within the container;

providing an RFID system comprising a mother RFID tag and a daughter RFID tag, the RFID system being adapted and configured to detect a change in position of the daughter tag relative to the mother tag;

placing one of the mother and daughter RFID tags adjacent the container;

placing the other of the mother and daughter RFID tags adjacent the article and within the container;

detecting with the RFID system whether a tamper condition has occurred, the tamper condition comprising a change in position of the daughter tag relative to the mother tag while the article is within the container;

the RFID system being adapted and configured to transmit a tamper signal upon detection of the tamper condition.

38. A method as set forth in claim 35 further comprising:

intermittently transmitting a status signal, the status signal being transmitted by the RFID system, the status signal being a tamper signal if the RFID system has detected the tamper condition after a point in time, the status signal being a non-tamper signal if the RFID system has not detected the tamper condition since the point in time, the tamper signal being different than the non-tamper signal.

39. A method comprising:

providing a plurality of assemblies, each assembly comprising a container having first and second container portions, an article within the container, and a detector mechanism, the detector mechanism comprising an RFID system positioned within the container, the RFID system comprising a plurality of RFID tags, the RFID system being adapted and configured to detect the occurrence of a position change tamper condition, the position change tamper condition comprising a change in position of at least a portion of the article within the container relative to one of the portions of the container;

transporting the plurality of assemblies in one shipment from an initial location to a quarantine location;

determining for each of the plurality of assemblies whether the detector mechanism corresponding to said each of the plurality of assemblies has detected the occurrence of the position change tamper condition, the determining step occurring with the plurality of assemblies at the quarantine location;

transporting the plurality of assemblies from the quarantine location to a destination location, the step of transporting the plurality of assemblies from the quarantine location to the destination location occuring after the determining step.

40. A method as set forth in claim 39 wherein the step of transporting the plurality of assemblies from the quarantine location to the destination location comprises transporting only those assemblies of which the determining step has determined that no tamper condition has occured.

41. A method as set forth in claim 39 wherein the position change tamper condition constitutes a first tamper condition, the detector mechanism of each assembly being further adapted and configured to detect the occurrence of a second tamper condition, the second tamper condition comprising at least one of the following: a removed tamper condition comprising removal of the article from the container; and a distance increase tamper condition comprising an increase in distance between the first and second container portions.

42. A method as set forth in claim 41 further comprising:

determining for each of the plurality of assemblies, while the plurality of assemblies are at the quarantine location, whether the detector mechanism corresponding to said each of the plurality of assemblies has detected the occurrence of the second tamper condition.

43. An anti-tamper life raft assembly comprising:

a container having a first container portion and a second container portion;

an inflatable life raft within the container;

an RFID system comprising a mother RFID tag and a daughter RFID tag, the mother RFID tag being attached to a portion of the container, the daughter RFID tag being attached to the life raft, the RFID system being adapted and configured to detect whether the mother and daughter RFID tags are spaced from each other by a distance greater than a distance D;

a transmitter mechanism adapted and configured to transmit a signal upon the occurrence of a position chance tamper condition and indicative of the position change tamper condition, the position change tamper condition comprising a change in position of at least a portion of the life raft within the container relative to one of the portions of the container as detected by the RFID system.

44. An anti-tamper life raft assembly as set forth in claim 43 wherein, the RFID system comprises the transmitter mechanism.

45. An anti-tamper life raft assembly as set forth in claim 44 wherein the RFID system is further adapted and configured to detect whether a distance increase tamper condition has occurred, the distance increase tamper condition comprising an increase in distance between the first and second container portions.

46. An anti-tamper life raft assembly as set forth in claim 45 wherein the RFID system is adapted to intermittently transmit a status signal, the status signal being a tamper signal after the occurrence of at least one of the position change tamper condition and the distance increase tamper condition, the status signal being a non-tamper signal before the occurrence of at least one of the position change tamper condition and the distance increase tamper condition.

47. An anti-tamper assembly comprising:

a container having a first container portion and a second container portion;

an article within the container;

a detector mechanism adapted and configured to detect whether a position change tamper condition, the position change tamper condition comprising a change in position of at least a portion of the article within the container relative to one of the portions of the container, the detector mechanism further being adapted and configured to detect whether a distance increase tamper condition has occurred, the distance increase tamper condition comprising an increase in distance between the first and second container portions; an RFID system, comprising a plurality of RFID tags, forming at least a portion of said detector mechanism, the RFID system being adapted and configured to transmit a signal upon the detection of any of the tamper conditions.

48. An anti-tamper assembly as set forth in claim 45 wherein the detector mechanism is adapted and configured to detect whether a removed tamper condition has occurred, the removed tamper condition comprising a condition in which the article has been removed from the container.

* * * * *